United States Patent [19]

Hotomi et al.

[11] Patent Number: 4,824,753

[45] Date of Patent: Apr. 25, 1989

[54] CARRIER COATED WITH PLASMA-POLYMERIZED FILM AND APPARATUS FOR PREPARING SAME

[75] Inventors: Hideo Hotomi, Suita; Shigeyuki Hakumoto, Toyonaka, both of Japan

[73] Assignee: Minolta Camera Kabushiki Kaisha, Osaka, Japan

[21] Appl. No.: 41,745

[22] Filed: Apr. 23, 1987

[30] Foreign Application Priority Data

Apr. 30, 1986 [JP] Japan ..... 61-100757
May 28, 1986 [JP] Japan ..... 61-124342

[51] Int. Cl.[4] ..... G03G 9/10
[52] U.S. Cl. ..... 430/108; 430/137
[58] Field of Search ..... 430/108, 137

[56] References Cited

U.S. PATENT DOCUMENTS

| | | | |
|---|---|---|---|
| Re. 31,072 | 11/1982 | Jadwin et al. | 430/99 |
| 3,533,835 | 10/1970 | Hagenbach et al. | 430/111 |
| 3,669,885 | 6/1972 | Wright et al. | 430/108 |
| 3,720,617 | 3/1973 | Chatterji et al. | 430/110 |
| 3,795,618 | 3/1974 | Kasper | 430/108 |
| 3,840,464 | 10/1974 | Van Engeland et al. | 430/108 |
| 3,873,356 | 3/1975 | Queener et al. | 430/137 |
| 3,898,170 | 8/1975 | Kasper | 430/108 |
| 3,916,065 | 10/1975 | Moriconi | 428/403 |
| 4,013,573 | 3/1977 | Leikhim et al. | 427/212 X |
| 4,062,693 | 12/1977 | Berger . | |
| 4,493,855 | 1/1985 | Sachder et al. | 430/314 X |
| 4,517,268 | 5/1985 | Gruber et al. | 430/39 |
| 4,518,673 | 5/1985 | Noguchi et al. | 430/108 |
| 4,555,466 | 11/1985 | Okada | 430/106.6 |
| 4,600,675 | 7/1986 | Iwasa et al. | 430/108 |
| 4,609,603 | 9/1986 | Knapp | 430/39 |
| 4,672,016 | 6/1987 | Isoda et al. | 430/108 |

FOREIGN PATENT DOCUMENTS

| | | |
|---|---|---|
| 60170865 | 4/1978 | Japan . |
| 59-200262 | 7/1984 | Japan . |

OTHER PUBLICATIONS

F. Lions, K. V. Martin, *Journal of the American Chemical Society*, 1957, 79, 2733–2738.

*Primary Examiner*—Roland E. Martin
*Attorney, Agent, or Firm*—Burns, Doane, Swecker & Mathis

[57] ABSTRACT

A carrier for use in electrophotographic developers is coated with a hydrocarbon film prepared by plasma polymerization. The film contains at least silicon or fluorine in addition to carbon as a main constituent.

6 Claims, 8 Drawing Sheets

CARRIER COATED WITH PLASMA-POLYMERIZED FILM AND APPARATUS FOR PREPARING SAME

BACKGROUND OF THE INVENTION

The present invention relates to a carrier for use in electrophotographic developers and an apparatus for producing the carrier, and more particularly to a ferrite carrier coated with a film prepared by plasma polymerization, i.e., a plasma-polymerized film.

Two-component developers comprising a toner and a carrier are used in electrophotography for developing electrostatic latent images by the cascade process, magnetic brush process or the like.

The toner contained in such a two-component developer is used for development and thereafter transferred and fixed to give copy images and is thereby consumed gradually, while the carrier is collected, recirculated and used again along with the toner.

When the carrier is repeatedly used by collection and recirculation, there arises the problem that toner particles adhere to carrier particles, impairing the characteristics of the carrier and affording copy images of lower quality.

For example, Unexamined Japanese Patent Publication No. SHO 59-53857 discloses a process for coating carrier particles with a resin such as a fluorocarbon resin to overcome the above problem.

Resin-coated carrier particles are prepared generally by blowing off carrier particles with heating in the form of a powder cloud, spraying the cloud with a coating solution of a resin in a solvent and drying the coated particles (spray-drying process), or by dipping carrier particles in a coating solution and removing the solvent by heating. These conventional processes for preparing coated carrier particles involve the problem of permitting agglomeration of carrier particles depending on the spraying condition or the amount of blow, and further the problem that the heating degrades the coated carrier substance. In fact, particles containing a low-melting point substance, such as binder-type carrier particles, can not be coated by the conventional process which involves heating.

The conventional processes have another problem in that the coated carrier particles obtained have a relatively thick coating and are uneven in the thickness of the coating. The thick coating gives rise to the problem that the carrier becomes triboelectrically charged to result in a charge buildup when repeatedly used. Furthermore, the carrier coated by the spray-drying process has the problem that some carrier particles remain locally uncoated, permitting adhesion of toner particles to the uncoated portion.

Briefly, the preparation of coated carrier involves the problem of agglomeration of carrier particles or degradation of the carrier, while the coated carrier obtained has the problem of large or uneven coating thickness or incomplete coating.

SUMMARY OF THE INVENTION

An object of the present invention is to overcome the foregoing drawbacks and to provide a carrier which is useful for electrophotographic developers and which is uniformly coated over the entire surfaces of its particles with a thin uniform film prepared by a low-temperature dry process, i.e., plasma polymerization.

Another object of the present invention is to provide a carrier which is outstanding in chargeability, abrasion resistance, water repellency, etc.

Another object of the present invention is to provide an apparatus for coating magnetic particles by a dry process.

More specifically, the present invention provides a carrier for electrophotographic development which is coated with a fluorine- and/or silicon-containing hydrocarbon film prepared by plasma polymerization.

The carrier of the present invention for use in electrophotographic developers is characterized in that the carrier is coated by a plasma polymerization process so as to provide electrophotographic developers having a reduced likelihood of agglomeration, degradation, etc.

The present invention further provides an apparatus for coating magnetic particles which is characterized in that the apparatus comprises means for producing a plasma for exciting a coating material, and means for transporting the magnetic particles in one direction while magnetically retaining and rotating the particles in the plasma.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE INVENTION

Figure 1:
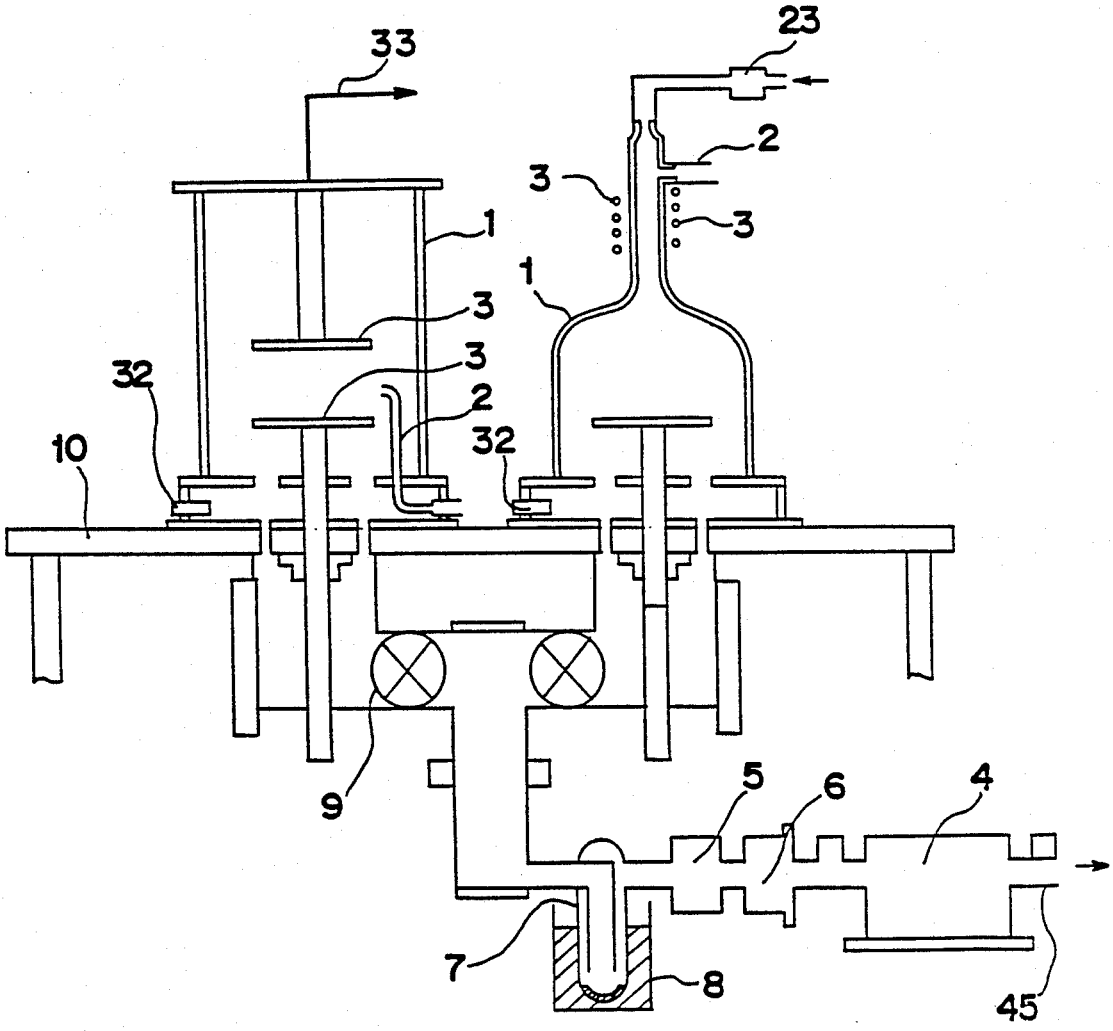
FIGS. 1 to 10 are schematic sectional views showing plasma polymerization apparatus which are usable for producing the carrier of the invention.

The carrier of the present invention is in the form of glass beads, steel beads, ferrite particles, fine iron particles or like particles which are usually used for carriers and which are coated with a film prepared from at least one organic compound by plasma polymerization. Especially desirable is a carrier prepared by coating ferrite particles with such a plasma-polymerized film. The cores of the carrier are 10 μm to 100 μm, more preferably 30 μm to 60 μm, in particle size.

The thickness of the plasma-polymerized film to obtain a satisfactory coated carrier is several tens of angstroms to several tens of thousands of angstroms, more preferably 500 angstroms to 7,000 angstroms. According to the present invention, even such a thin film affords uniformly and thoroughly coated carrier particles. If smaller than 80 angstroms in thickness, the film becomes worn away when the carrier is used as incorporated in the developer, whereas if the film thickness is larger than 15,000 angstroms, the carrier becomes charged up to a high level and no longer usable as such.

The plasma-polymerized film coating the carrier has incorporated therein fluorine atoms and/or silicon atoms. The presence of these atoms improves the carrier in chargeability, electric resistance, abrasion resistance, water repellency, etc. The content of fluorine or silicon or the combined content of both elements is 5 to 60% by weight, more preferably 10 to 40% by weight, based on the total amount of the plasma-polymerized film. If the content is less than 5% by weight, the carrier exhibits lower resistance to ambient conditions, especially to moisture, lower ability to release spent toner and a delayed rise in the amount of charges and results in a reduced amount of saturation charges after rising. When the content exceeds 60% by weight, the film will not be formed satisfactorily, while the amount of charges on the resulting film becomes excessive, possibly rendering the carrier unusable as such.

The plasma-polymerized film coating the carrier may contain metal atoms. The carrier then exhibits diminished variations in the amount of charges during copying operation, retaining a stabilized amount of charges at all times. This effect is especially remarkable in the initial stage of agitation. The metal content is preferably 0.1 to 9% by weight, more preferably 1 to 4% by weight, based on the total amount of the plasma-polymerized film. With less than 0.1% by weight of metal present, the above effect is not available, whereas presence of more than 9% by weight of metal results in impaired chargeability.

The contents of fluorine and/or silicon, and metal are adjustable by selecting a suitable monomer material or suitable plasma polymerization conditions.

The carrier coated with a plasma-polymerized film which contains fluorine atoms and/or silicon atoms and which may further contain metal atoms when desired can be prepared by a plasma polymerization process using a fluorine- or silicon-containing aliphatic hydrocarbon, a fluorine- or silicon-containing aromatic hydrocarbon, mixture of these hydrocarbons, or mixture of such a compound and some other aliphatic or aromatic hydrocarbon, which may further be admixed with at least one of metal vapor, organometallic gas and organometallic compound as sublimed to a gas. These compounds or mixtures are used in the form of a gas.

The fluorine- or silicon-containing aliphatic hydrocarbon effectively forms a harder and compacter film than the fluorine- or silicon-containing aromatic hydrocarbon although lower in deposition rate. The same result is also achieved when these compounds are conjointly used with a fluorine- or silicon-free aromatic hydrocarbon or aliphatic hydrocarbon for polymerization.

Thus, the plasma-polymerized film of the present invention is prepared from a gas containing at least one organic compound having a fluorine atom and/or a silicon atom in its structure by subjecting the gas to plasma polymerization, whereby the fluorine atom and/or silicon atom contained in the organic compound can be effectively incorporated into the resulting film to fully serve the contemplated function.

The amount of fluorine, silicon or metal atoms to be incorporated into the plasma-polymerized film is greatly influenced by the plasma conditions including pressure, substrate temperature, applied voltage, spacing between the electrodes, form of the gas supplied and form of the gas discharged. One of the features of the present invention is that these atoms can be incorporated into the plasma-polymerized film efficiently with good stability without being influenced by these plasma conditions.

According to the invention, the compound containing a fluorine, silicon or metal atom in its structure is subjected in a vapor phase to a plasma polymerization reaction. However, the compound need not always be in a vapor phase at room temperature and at atmospheric pressure. The compound can be in a liquid or solid phase insofar as it can be vaporized by heating, application of a vacuum or some other method, for example, through melting, evaporation or sublimation.

While vinyl fluoride, vinylidene fluoride or the like is usable as the fluorine atom-containing organic compound in the present invention, also useful as such compounds are alkyl fluorides, aryl fluorides, styrene fluoride, fluorohydrins, fluoroform, etc.

Examples of useful alkyl fluorides are methyl fluoride, ethyl fluoride, propyl fluoride, butyl fluoride, amyl fluoride, hexyl fluoride, heptyl fluoride, octyl fluoride, nonyl fluoride, decyl fluoride and the like.

Examples of useful aryl fluorides are fluorostyrene and the like.

Examples of useful fluorohydrins are ethylene fluorohydrin and the like.

The compound of the following structural formula is an example of especially preferred fluorine-containing monomer.

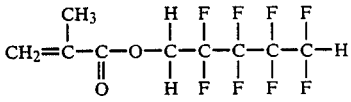

(The monomer of the above formula will hereinafter be referred to as "$F_8C_5MA$.")

Examples of silicon atom-containing organic compounds useful for the invention are trichlorosilane, trichloromethylsilane, trichlorovinylsilane, trichloro-β-cyanoethylsilane, trichloro-γ,γ,γ-trifluoropropylsilane, trichlorophenylsilane, trichlorochlorophenylsilane, dichloromethlsilane, dichlorodimethylsilane, dichloromethylvinylsilane, dichlorodivinylsilane, dichloromethyl-γ,γ,γ-trifluoropropylsilane, dichlorodiphenylsilane, dichloromethylphenylsilane, chlorodimethylsilane, chlorotrimethylsilane, chlorodimethyl-tert-butylsilane, chlotriphenylsilane, tetramethylsilane, β-(3,4-epoxyclohexyl)ethyltrimethoxysilane, γ-glycidoxypropyltrimethoxysilane, γ-methacryloxypropyltrimethoxysilane, γ-chloropropyltrimethoxysilane, γ-mercaptopropyltrimethoxysilane, γ-aminopropytrimethoxysilane, N-(β-aminoethyl)-γ-aminopropyltrimethoxysilane, N-(β-aminoethyl)-γ-aminopropylmethyldimethoxysilane, phenylsilatolan, tetramethyldisiloxane, hexamethyldisiloxane, tetramethyldivinyldisiloxane, hexamethyldisilazane, N-trimethylsilylacetamide, N,O-bistrimethylsilylacetamide, etc. Also useful are monosilane, disilane and the like which are inorganic gases.

Examples of useful metals and metal-containing compounds are as follows.

| | |
|---|---|
| Al: | $Al(Oi\text{-}C_3H_7)_3$, $(CH_3)_3Al$, $(C_2H_5)_3Al$, $(i\text{-}C_4H_8)_3Al$, $AlCl_3$ |
| Ba: | $Ba(OC_2H_5)_3$ |
| Ca: | $Ca(OC_2H_5)_3$ |
| Fe: | $Fe(Oi\text{-}C_3H_7)_3$, $(C_2H_5)_2Fe$, $Fe(CO)_5$ |
| Ga: | $Ga(Oi\text{-}C_3H_7)$, $(CH_3)_3Ga$, $(C_2H_5)_3Ga$, $GaCl_3$, $GaBr_3$ |
| Ge: | $GeH_4$, $GeCl_4$, $Ge(OC_2H_5)_4$, $Ge(C_2H_4)_4$ |
| Hf: | $Hf(Oi\text{-}C_3H_7)_4$ |
| In: | $In(Oi\text{-}C_3H_7)_3$, $(C_2H_5)_3In$ |
| K: | $KOi\text{-}C_3H_7$ |
| Li: | $LiOi\text{-}C_3H_7$ |
| La: | $La(Oi\text{-}C_3H_7)_4$ |
| Mg: | $Mg(OC_2H_5)_2$, $(C_2H_5)_2Mg$ |
| Na: | $NaOi\text{-}C_3H_7$ |
| Nb: | $Nb(OC_2H_5)_5$ |
| 5b: | $Sb(OC_2H_5)_3$, $SbCl_3$, $SbH_3$ |
| Sr: | $Sr(OCH_3)_2$ |
| Ti: | $Ti(Oi\text{-}C_3H_7)_4$, $Ti(OC_4H_9)_4$, $TiCl_4$ |
| Si: | $SiH_4$, $Si_2H_6$, $(C_2H_5)_3SiH$, $SiF_4$, $SiH_2Cl_2$, $SiCl_4$, $Si(OCH_3)_4$, $Si(OC_2H_5)_4$ |
| Ta: | $Ta(OC_2H_5)_5$ |
| V: | $VO(OC_2H_5)_3$, $VO(Ot\text{-}C_4H_9)_3$ |
| Y: | $Y(Oi\text{-}C_3H_7)_3$ |
| Zn: | $Zn(OC_2H_5)_2$, $(CH_3)_2Zn$, $(C_2H_5)_2Zn$ |
| Zr: | $Zr(Oi\text{-}C_3H_7)_4$ |
| Sn: | $(CH_3)_4Sn$, $(C_2H_5)_4Sn$, $SnCl_4$ |
| Cd: | $(CH_3)_2Cd$ |
| Co: | $Co_2(CO)_5$ |
| Cr: | $Cr(CO)_6$ |
| Mn: | $Mn_2(CO)_{10}$ |
| Mo: | $Mo(CO)_6$, $MoF_3$, $MoCl_6$ |
| W: | $W(CO)_6$, $WCk_6$, $WF_6$ |

Also usable are vinyl metal monomers, metal phthalocyanines, etc.

The hydrocarbons which are usable in combination with the foregoing compounds include, for example, aliphatic hydrocarbons, such as paraffinic hydrocarbons, ethylenic hydrocarbons, acetylenic hydrocarbons and alicyclic hydrocarbons, aromatic hydrocarbons, etc.

Examples of useful paraffinic hydrocarbons are normal paraffins such as methane, ethane, propane, butane, pentane, hexane, heptane, octane, nonane, decane, undecane, dodecane, tridecane, tetradecane, pentadecane, hexadecane, heptadecane, octadecane, nonadecane, eicosane, heneicosane, docosane, tricosane, tetracosane, pentacosane, hexacosane, heptacosane, octacosane, nonacosane, triacontane, dotriacontane, pentatriacontane, etc.; isoparaffins such as isobutane, isopentane, neopentane, isohexane, neohexane, 2,3-dimethylbutane, 2-methylhexane, 3-ethylpentane, 2,2-dimethylpentane, 2,4-dimethylpentane, 3,3-dimethylpentane, tributane, 2-methylheptane, 3-methylheptane, 2,2-dimethylhexane, 2,2,5-dimethylhexane, 2,2,3-trimethylpentane, 2,2,4-trimethylpentane, 2,3,3-trimethylpentane, 2,3,4-trimethylpentane, isononane, etc.; and the like.

Examples of useful ethylenic hydrocarbons are olefins such as ethylene, propylene, isobutylene, 1-butene, 2-butene, 1-pentene, 2-pentene, 2-methyl-1-butene, 3-methyl-1-butene, 2-methyl-2-butene, 1-hexene, tetramethylethylene, 1-heptene, 1-octene, 1-nonene, 1-decane and the like; diolefins such as allene, methylallene, butadiene, pentadiene, hexadiene, cyclopentadiene and the like; triolefins such as ocimene, alloocimene, myrcene, hexatriene and the like; etc.

Examples of useful acetylenic hydrocarbons are acetylene, methylacetylene, 1-butyne, 2-butyne, 1-pentyne, 1-hexyne, 1-heptyne, 1-octyne, 1-nonyne, 1-decyne and the like.

Examples of useful alicyclic hydrocarbons are cycloparaffins such as cyclopropane, cyclobutane, cyclopentane, cyclohexane, cycloheptane, cyclooctane, cyclononane, cyclodecane, cycloundecane, cyclododecane, cyclotridecane, cyclotetradecane, cyclopentadecane, cyclohexadecane and the like; cycloolefins such as cyclopropene, cyclobutene, cyclopentene, cyclohexene, cycloheptene, cyclooctene, cyclononene, cyclodecene and the like; terpenes such as limonene, terpinolene, phellandrene, sylvestrene, thujene, carene, pinene, bornylene, camphene, fenchene, cyclofenchene, tricyclene, bisabolene, zingiberene, curcumene, humulene, cadinene sesquibenihene, selinene, caryophyllene, santalene, cedrene, camphorene, phyllocladene, podocarprene, mirene and the like; steroids; etc.

Examples of useful aromatic hydrocarbons are benzene, toluene, xylene, hemimellitene, pseudocumene, mesitylene, prehnitene, isodurene, durene, pentamethylbenzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene and the like.

The carrier of the present invention coated with a plasma-polymerized film can be prepared by plasma polymerization using at least one of the foregoing fluorine- or silicon-containing compounds, which may be used in combination with at least one of the aforementioned metals or metal-containing compounds when desired. Plasma polymerization processes are generally divided into two type: one which is conducted in an apparatus having parallel discharge electrodes each in the form of a flat plate and disposed within a bell jar or reactor (parallel electrode type resorting to capacitive coupling), and the other which is conducted using an apparatus of the inductive coupling type comprising a coiled electrode provided around a bell jar. One of these apparatus may be used selectively in accordance with the mode of coating the carrier. FIG. 1 shows examples of these polymerization apparatus, i.e. a plasma polymerization apparatus of the parallel electrode type (at left in FIG. 1) and a plasma polymerization apparatus of the inductive coupling type (at right). The two apparatus, although shown as supported on a single table 10, are actually independent of each other.

The apparatus of the parallel electrode type shown on the left-hand side of FIG. 1 comprises parallel flat platelike electrodes 3 arranged as opposed to each other within a reactor 1. The electrodes are connected to a high-frequency or low-frequency power supply. A monomer gas is introduced into the reactor through a monomer supply duct 2 along with a carrier gas flowing in via a carrier gas supply duct 23. When the monomer to be used is liquid, the monomer is vaporized by an unillustrated vaporizer and then similarly fed through the duct 2. Before reaction, the interior of the reactor 1 is evacuated by operating a valve 9 and an oil rotary pump 4. A vacuum gauge 32 indicates the degree of vacuum produced. During this procedure, the gas discharged from the reaction system via a gas outlet 45 is removed by a cold trap 7 and a mechanical booster pump 5, while particles are collected by a particle filter 6. Alternatively, particles may be collected magnetically. A carrier can be coated with a plasma-polymerized film using this apparatus by placing the carrier as contained in a suitable container on the lower electrode 3 under the upper electrode connected to the power supply and subjecting the monomer gas to plasma polymerization while vibrating or rolling the carrier particles by a suitable method.

The plasma polymerization apparatus of the inductive coupling type (at right in FIG. 1) has basically the same construction as the apparatus of the parallel electrode type (at left in FIG. 1) except that the reactor 1 is externally provided with an electrode portion 3 and therefore has a different shape. The apparatus of the inductive coupling type is especially useful when coating a carrier with a plasma-polymerized film while allowing the carrier to fall.

FIGS. 2 to 14 show more specific modes of coating a carrier with a plasma-polymerized film using these apparatus. For simplified illustration, the discharge electrode assembly and the vapor deposition portion are chiefly shown in each of FIGS. 3 to 10.

Figure 2:
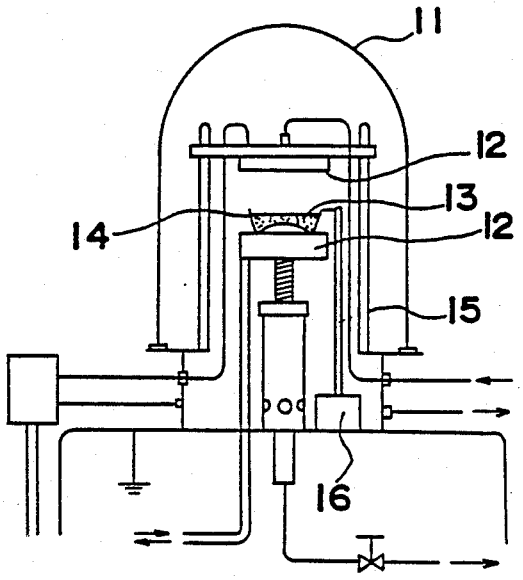

FIG. 2 shows a plastic container 14 containing carrier particles 13 and placed on the lower of parallel flat platelike electrodes 12 which are housed in a bell jar 11. A vibrator 16 has a vibrating bar 15 in contact with the container 14 to vibrate the container in its entirety. The vibration brings the particles 13 in the container 14 into a convectional movement. The monomer (organic compound) introduced into the bell jar 11 is polymerized in a plasma produced by supplying high- or low-frequency power to the electrodes 12. Since the particles 13 are in a convectional motion at all times, the particles can be individually coated uniformly with a plasma-polymerized film during a given period of deposition.

Figure 3:
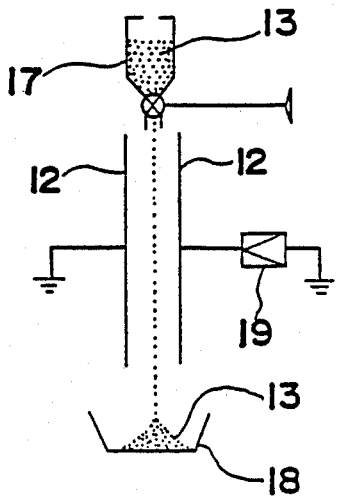

FIG. 3 shows a mode wherein carrier particles 13 are allowed to fall from a hopper 17 in small portions through a plasma produced by vertically elongated parallel plate electrodes 12, whereby the carrier particles are coated. The coated carrier is collected in a tray 18.

Figure 4:
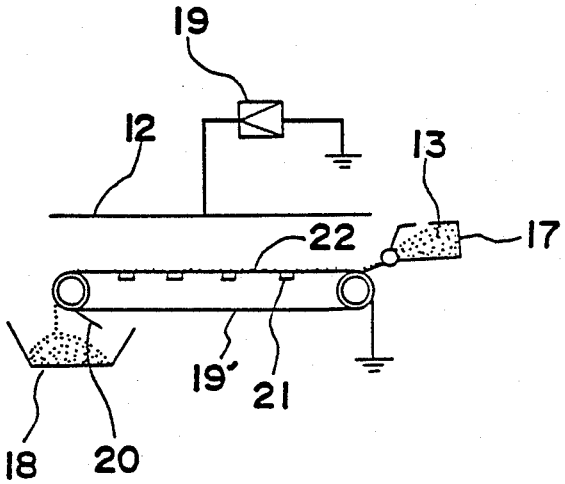

FIG. 4 shows a method wherein carrier particles 13 are fed from a hopper 17 to a conveyor belt 22 which serves also as an electrode, and the monomer is subjected to plasma polymerization on the belt during its travel. The belt is vibrated by vibrators 21 attached to the belt at a spacing, with the result that the particles are uniformly coated while being rolled on the belt by the vibration. The carrier coated in the discharge zone is scraped off by a blade 20 and collected in a tray 18. This method is suited to quantity production.

Figure 5:
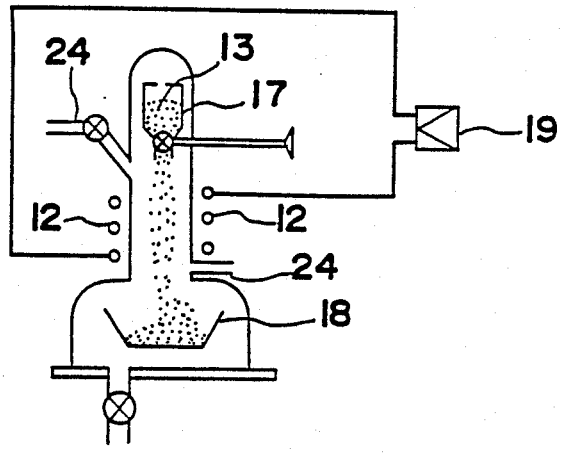

FIG. 5 shows a method resorting to inductive coupling with power from external electrodes 12 and based on substantially the same principle as that of FIG. 2. In this method, high- or low-frequency power is applied by the electrode 12 to an inert gas supplied from a duct 23 to excite the gas, which in turn supplies energy to a monomer fed from a supply duct 24 to coat carrier particles 13 falling from a hopper 17. With the plasma energy thus given indirectly, this method has the advantage of reduced damage due to the plasma. Since the location where the plasma is produced is separate from the deposition portion, this method also has the advantage that the plasma can be supplied stably.

Figure 6:
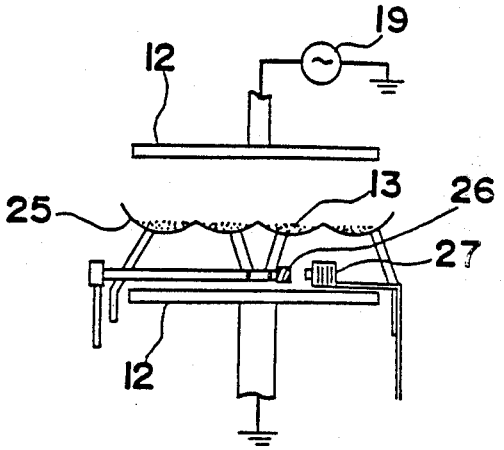

FIG. 6 shows an insulating dish 25 having concave recesses to which carrier particles 13 are supplied. While the dish 25 is being vibrated by a vibrator comprising an electromagnet 27 and a permanent magnet 26, a plasma is produced between electrodes 12 to coat the carrier particles 13. When the dish 25 is vibrated at its natural frequency by the vibrator thereunder to set a mode wherein the particles 13 roll along in every direction in the most intensive convectional motion, the particles can be coated uniformly more effectively.

Figure 7:
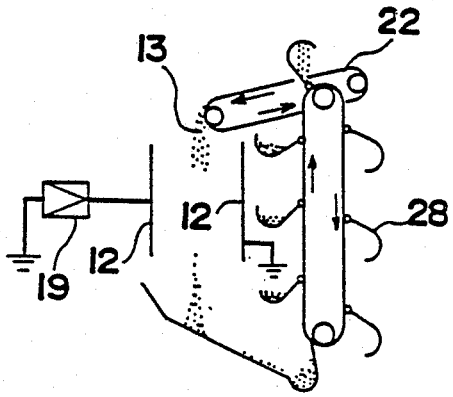

FIG. 7 shows a cascade method which is based on the same principle as that of FIG. 2. A cascade 28 makes it possible to coat carrier particles 13 repeatedly many times, so that the thickness of the film can be controlled according to the number of repetitions. This method is suited to quantity production.

Figure 8:
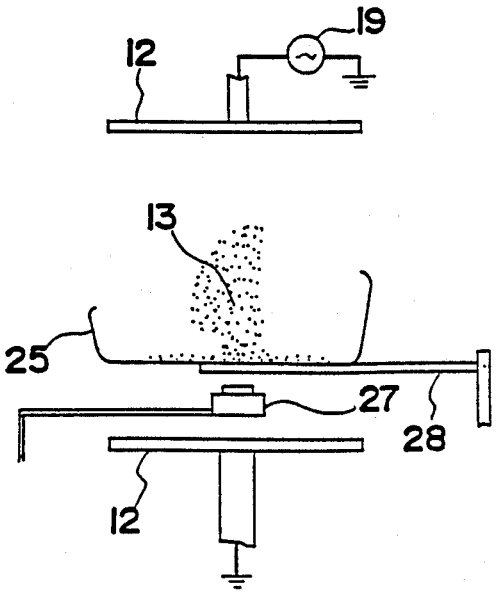

FIG. 8 shows a method characterized in that an inusulating dish 25 resembling a frying pan and supported by a plate spring 28 is vibrated by vibrating the spring 28 with an electromagnet 27 provided under the spring 28. Carrier particles 13 in the dish 25 are forced to jump up by the vibration, and while being thus jumped up, they are coated by plasma polymerization. The carrier particles can be uniformly coated also by this method.

Figure 9:
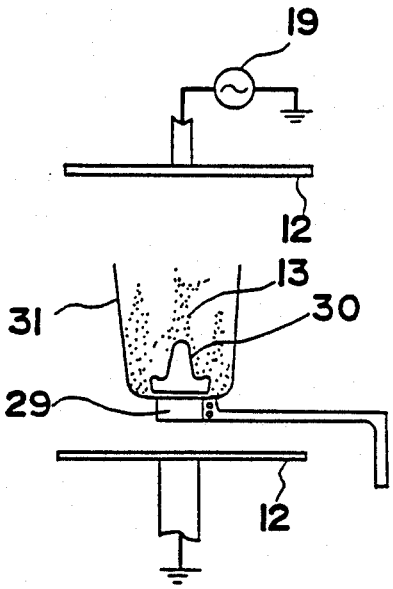

FIG. 9 shows a plasma polymerization coating method based on the principle of mixers. With this method, carrier particles in a container 31 are uniformly coated while being rolled and moved in suspension by rotating a rotor 30 at a high speed by a motor 29.

Figure 10:
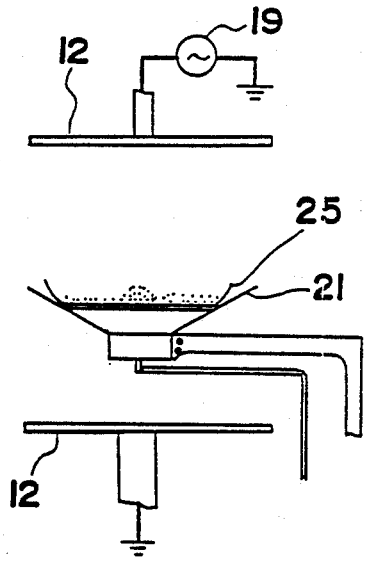

FIG. 10 shows a plasma polymerization coating method utilizing a vibrator 21 resembling a loudspeaker diaphgram. According to this method, the vibrator 21 having a dish 25 attached thereto is vibrated on the principle of loudspeakers, whereby carrier particles in the dish 25 are rolled, vibrated and brought into a convectional motion to coat the particles uniformly with a plasma-polymerized film.

The plasma polymerization process of the present invention, which is a low-temperature dry process, is free of the likelihood that the particles to be coated will be degraded with heat or solvents or will agglomerate.

When a carrier having a high glass transition temperature or melting point is to be coated uniformly with a thin film, the plasma polymerization process may be conducted with heating using a heater as attached to the electrode of the shape shown, for example, in FIG. 4, 6, 8, 9 or 10. When carrier particles are rolled or moved in suspension by a vibrator, spring plate or the like for plasma polymerization, it is desirable that the entire system be preheated fully.

Figure 11:
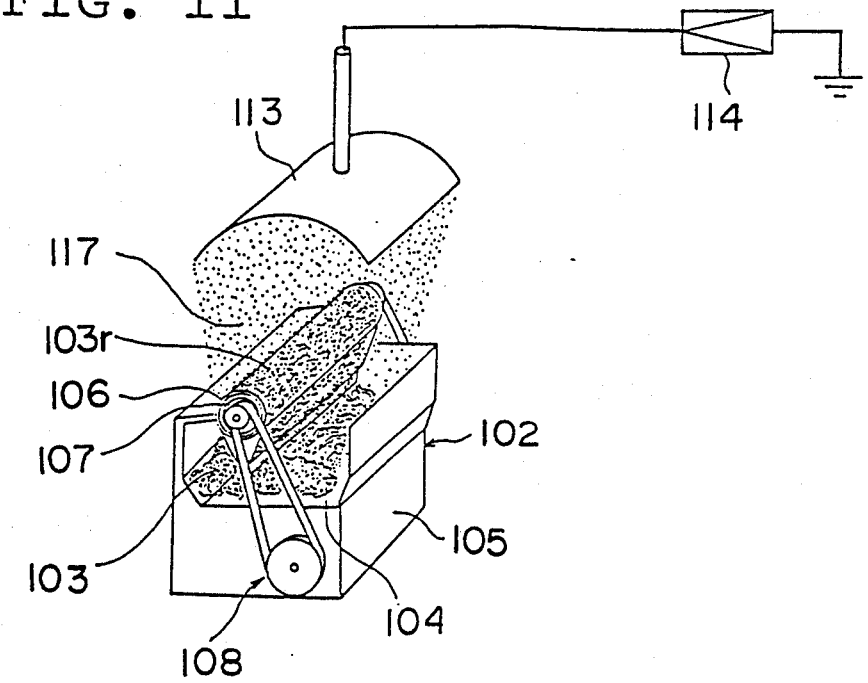
FIGS. 11 to 13 show a plasma polymerization apparatus which is usable for producing the carrier of the invention, FIG. 11 being a perspective view, FIG. 12 being a schematic view, and FIG. 13 being a diagram illustrating the operation of the apparatus.
Figure 12:
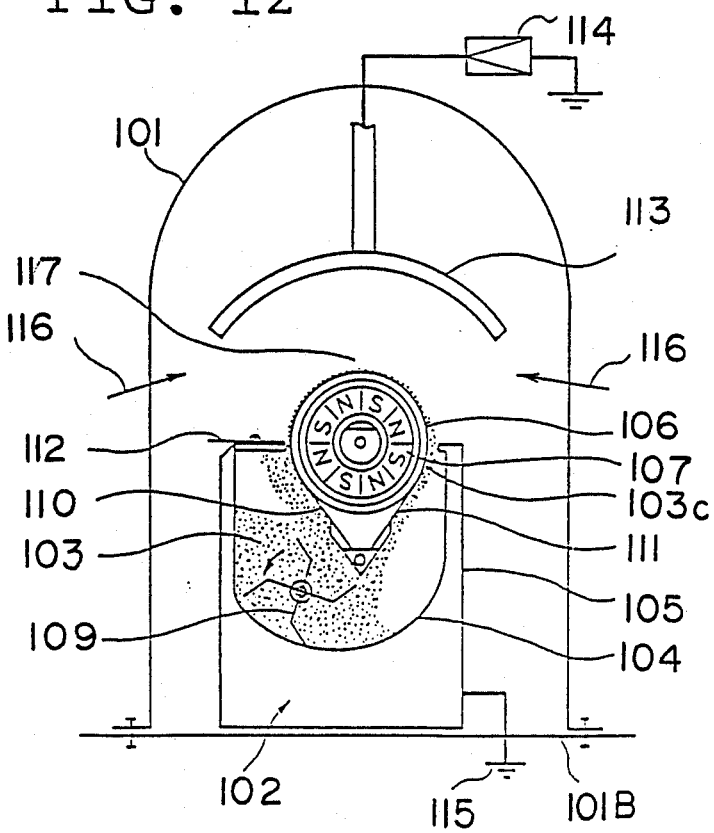
Figure 13:
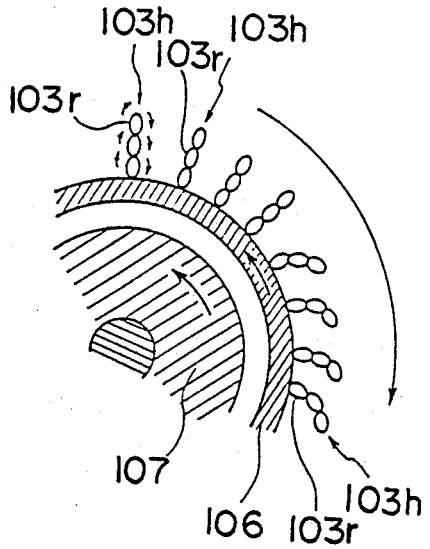

FIGS. 11 to 13 show an apparatus wherein a magnetic carrier is coated with a plasma-polymerized film while being rotated as supported on a rotating sleeve 106.

With reference to these drawings, the apparatus comprises a vacuum container 101 gas-tightly installed on a base plate 101B, and a device 102 provided within the container 101 for transporting finely divided ferrite 103 in one direction while rotating ferrite particles 103*r* and restraining the particles 103*r* by a magnetic field.

The rotation-transport device 102 consists essentially of a casing 105 having a ferrite container 104 in its upper portion, the above-mentioned sleeve 106 positioned above the container 104 and rotatably supported by the casing 105, a magnet roller 107 provided inside the sleeve 106 and a drive assembly 108 including an unillustrated motor for rotating the sleeve 106 and the magnet roller 107.

The sleeve 106 is in the form of a hollow cylinder of aluminum or like nonmagnetic electrically conductive material and is rotated by the drive assembly 108 at a low speed n (r.p.m.) in a counterclockwise direction in the drawings. The magnet roller 107 is in the form of a roll having N poles and S poles arranged alternately along its periphery as seen in FIG. 12 and is rotated in the same direction as the sleeve 106 at a high speed N (r.p.m.).

The container 104 is provided with a rotortype agitator 109 rotatable for agitating the finely divided ferrite 103 to be coated and has in engagement with the sleeve 106 a guide plate 110 for guiding the ferrite 103 for upward transport, and a scraper 111 for scraping the coated product off the sleeve 106 into the container at the terminal end of path of transport. A restricting plate 112 is finely adjustably provided at the upper end of the casing 105 on one side of the sleeve 106 where the transport of ferrite particles is started. The restricting plate 112 has an edge resembling a knife edge and positioned close to the surface of the sleeve 106 and is adapted to restrict the number of ferrite particles 103*r* forming each bristle of ferrite transported, as illustrated in FIG. 13. Preferably, the sleeve 106 is equipped with a heater. With the present embodiment, a sheathed heater is disposed in the space between the magnet roller 107 and the sleeve 106. Instead of heating the sleeve from inside in this way, the sleeve may be heated from outside by radiation. The heater is operated when required for causing the coating material to readily adhere to the ferrite particles.

The vacuum container 101 shown in FIG. 12 is provided in its interior with an electrode 113 which is curved with the same curvature as the sleeve 106. An external high-frequency power supply 114 is connected to the electrode. The electrode 113 serves as an upper electrode of the capacitive coupling type and pairs with the sleeve 106 serving as a lower electrode. The sleeve 106 is grounded as indicated at 115. The container 101 can be maintained at a predetermined vacuum. Via one or a plurality of gas supply inlets, the gaseous substance 116 (coating material) to be applied to the finely divided ferrite 103 is supplied to the container 101, singly or along with a carrier gas such as argon gas. A plasma 117 of the coating material is produced between the upper electrode 113 and the lower electrode, i.e., the sleeve 106.

When the magnet roller 107 and the sleeve 106 are rotated, the finely divided ferrite 103 is magnetically restrained and attracted to the sleeve surface by the magnet roller 107 and is transported clockwise in FIG. 13 owing to a difference in rotational speed therebetween. The ferrite in transport on the sleeve 106 forms bristles 103*h*, for example, of three ferrite particles 103*r* each which are magnetically joined to one another in the form of a straight chain as seen in FIG. 13. The bristles 103*h* retain their form despite the successive change of polarity of the magnet roller 107, while the ferrite particles 103*r* of the bristles 103*h* rotate (roll) in their individual positions with the successive change of polarity of the magnet roller 107. The plasma 117 equally acts on the ferrite particles 103*r* thus rotating during transport, forming a homogenous and uniform film on the ferrite particles 103*r* successively by virtue of polymerization of molecules. The coated ferrite particles 103*c* are scraped off the sleeve 106 by the scraper 111 upon entering the container 104 and fall into the container 104.

The thickness of the coating film formed varies with the kind of the gas of coating material 116, temperature of the sleeve 106, discharge frequency and power of the power supply 114, density of the plasma 117 produced, period of time taken for the finely divided ferrite 103 to pass through the plasma 117, i.e. speed of the sleeve 106 and the magnet roller 107 relative to each other, etc. Conversely, the film thickness is controllable as desired by determining these parameters and is variable from several tens of angstroms to several thousands of angstroms. The film is uniform in both thickness and quality. The greatest parameter is the passage time. Although the sleeve 106 and the magnet roller 107 are both rotated counterclockwise according to the present embodiemnt, they may be rotated clockwise or in directions opposite to each other. Further the sleeve 106 may be stationary, with the magnet roller 107 only made rotatable. The desired film thickness can be obtained by subjecting the coated ferrite particles 103*c* to plasma polymerization again, i.e. by circulating the coated product using the agitator 109 or the like to form a film repeatedly a number of times. However, it is possible to obtain a film of desired thickness by one cycle of treatment when the foregoing parameters are suitably selected.

Figure 14:
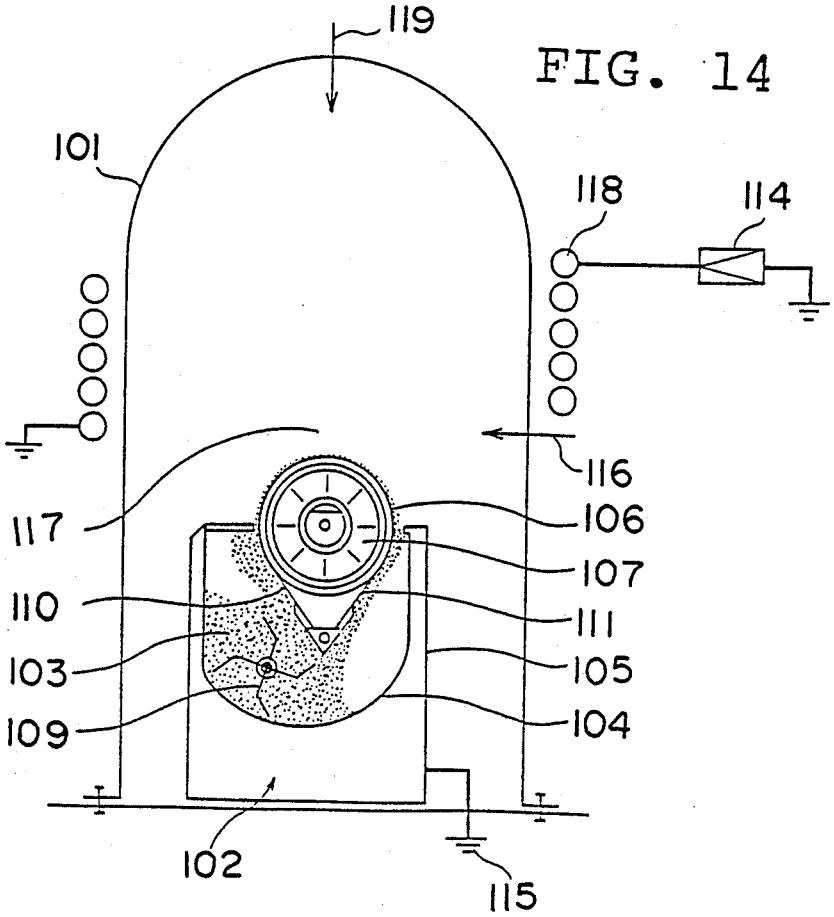
FIG. 14 is a diagram showing a modification of the apparatus of FIG. 13.

FIG. 14 shows the above apparatus of the capacitive coupling type as modified to the inductive coupling type. The modified apparatus has the same construction as the above apparatus except that the vacuum container 101 is provided at an upper portion thereof with a coil 118 equipped with a cooling water pipe and connected to a power supply 114, so that the apparatus will not be described.

Since the apparatus described above are adapted for plasma-coating magnetic particles, these apparatus are usable for coating not only carriers for use in electrophotographic copying process but also for magnetic particles for magnetic tapes, discs, etc.

When a carrier is coated with a plasma-polymerized film according to the present invention, the carrier itself can be improved in chargeability, electric resistance, abrasion resistance, ability to release spent toner, water repellency, etc. and can also be made controllable in electrification rank.

The carrier coated with the plasma-polymerized film of the invention can be used in combination with a known toner for use as an electrophotographic developer in a known manner.

The developer incorporating the coated carrier of the invention has improved flowability and is controllable in chargeability, charge rise time, stability for repeated use, etc.

The present invention will be described in greater detail with reference to the following examples.

EXAMPLE 1

A ferrite carrier (40 to 60 μm in particle size) was coated with use of the plasma polymerization apparatus shown in FIG. 6 by supplying 25 sccm of butadiene and 110 sccm of $F_8C_5MA$ (methacrylate) into the reactor through gas inlets. A plasma-polymerized film was deposited under the following conditions. The coated carrier obtained will be referred to as "carrier A."

| | |
|---|---|
| Deposition time: | 65 minutes |
| Frequencey: | 13.56 MHz |
| Power: | 90 W |
| Gas pressure: | 1.4 torr in total |
| Substrate: | At room temperature for starting |

Carrier A obtained was about 0.28 μm in film thickness and about 48 μm in mean particle size of the carrier cores.

Carrier A and a toner of positive polarity (12.8 μm in mean particle size) having the following composition were placed into a polyethylene bottle in a mixing ratio of 8% and then agitated to prepare a developer.

| Toner composition | |
|---|---|
| Styrene-acrylic resin ($\overline{M}n$: 12,400, $\overline{M}w$: 43,300, Tg: 62° C., softening point: 124° C.) | 100 parts by weight |
| Carbon black (MA#8, product of Mitsubishi Chemical Industries, Ltd.) | 5 parts by weight |
| Charge control agent (BONTRON N-01m product of Orient Chemical Industries, Ltd.) | 3 parts by weight |

Figure 15:
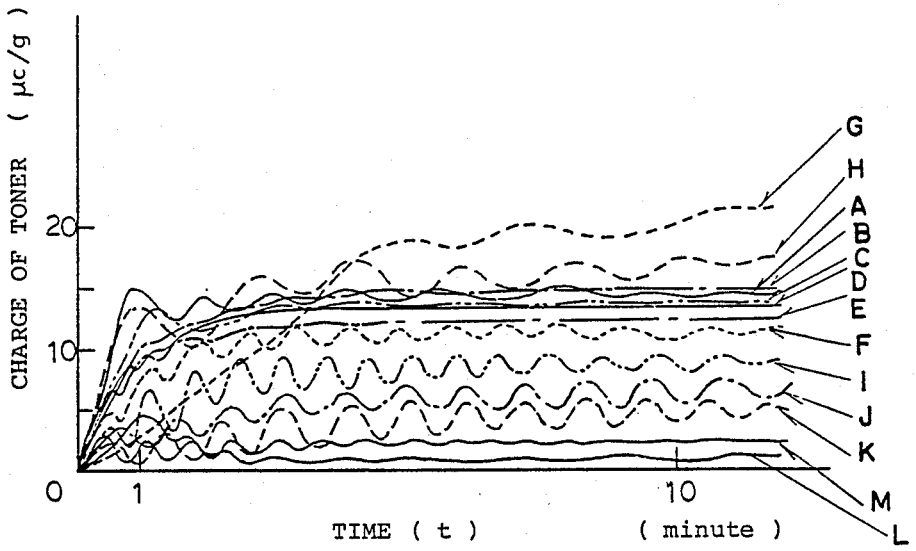
FIG. 15 is a graph showing rising characteristics of the amount of charges on a toner as determined with use of carriers of the invention and conventional carriers.
Figure 18:
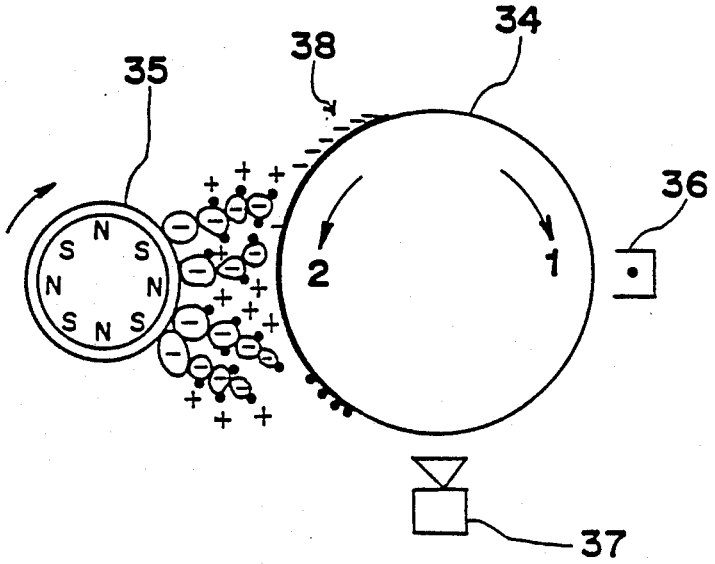
FIG. 18 is a diagram showing a device for measuring the amount of charges on the toner.

The developer thus prepared was checked for the amount of charges, Qf($\mu$c/g), and charge rise time using a developing process tester. FIG. 18 schematically shows the construction of the tester, which comprises a drum 34, and a developing unit 35, a charger 36 and a surface potentiometer 37 which are arranged around the drum. First, a Mylar film 38 (of known electrostatic capacity) was affixed to the drum in intimate contact therewith and uniformly charged by the charger, and the surface potential V0 was measured. Next, the drum was reversely rotated to develop the film, and the surface potential V1 was thereafter measured. The potential difference, V0–V1, corresponds to the amount of charges on the toner on the developed film. Subsequently, the amount of toner, Dv mg/cm$^2$, deposited on the developed film was measured. The amount of charges on the toner, Qf $\mu$c/g, was calculated from these values. FIG. 15 shows the result. Table 2 shows the amounts of charges on the toner 1 minute later and 10 minutes later.

Figure 16:
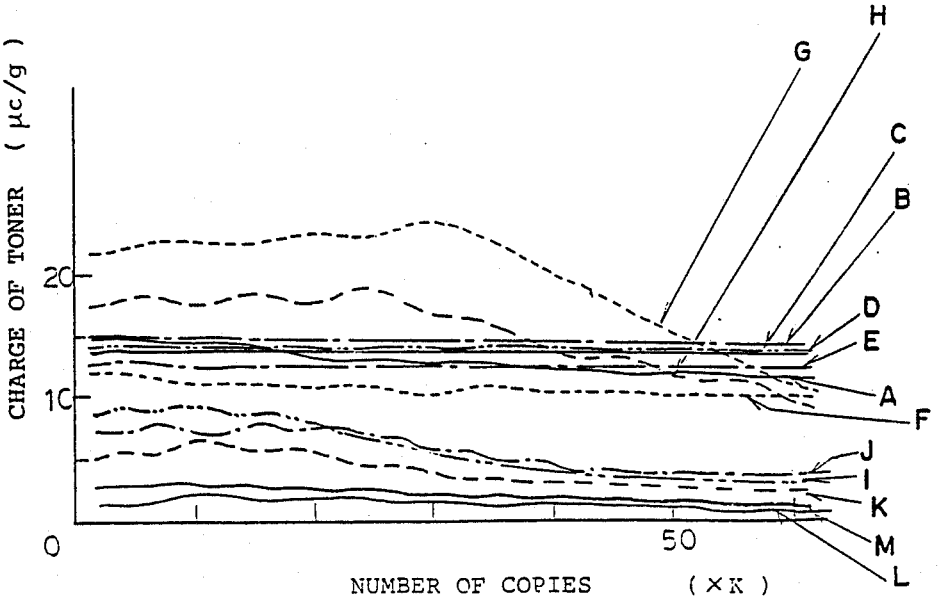
FIG. 16 is a graph showing repetition characteristics of the amount of toner charges as determined using carriers of the invention and conventional carriers.

The developer was further used for copying operation to determine the repetition characteristics of the amount of charges on the toner. FIG. 16 shows the result.

Figure 17:
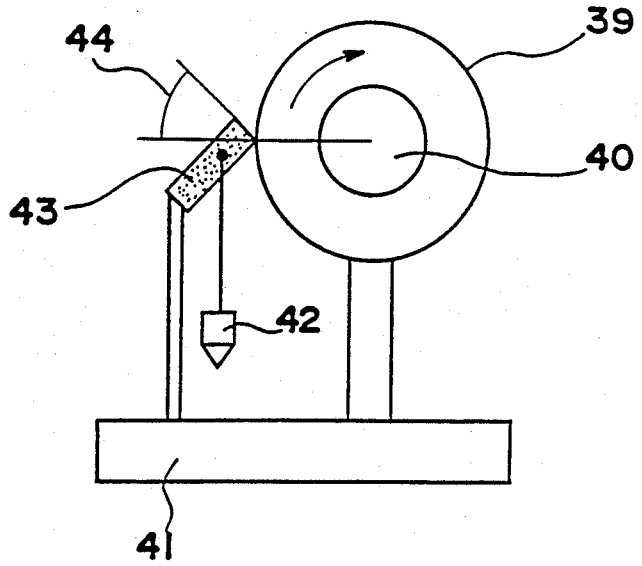
FIG. 17 is a diagram showing a device for testing carrier coating films for abrasion resistance.

Next, the abrasion resistance of the carrier was evaluated using an abrasion tester, which is schematically shown in FIG. 17. The same coating substances as used in Example 1 were plasma-polymerized on an aluminum drum 39, 80 mm in diameter, under the same conditions as above. A sintered plate 43, 10 mm in thickness, was prepared by dispersing 20 parts by weight of ferrite carrier, 48 $\mu$m in particle size, in 100 parts by weight of the same styrene-acrylic resin as used for preparing the toner, and sintering the dispersion. The sintered plate 43 was held in line contact with the coated drum 39 at a contact angle 44 of 45 degrees under a line pressure of about 5 g/mm using a weight 42, and the drum was rotated in this state at 100 r.p.m. for about 10 hours by a motor 40. The film on the drum was then checked for the resulting flaws in comparison with a reference sample (prepared by MINOLTA). Table 2 shows the result.

With reference to Table 2, the abrasion resistance was evaluated according to the criteria of: Go (good), No (no problem) and Po (poor).

Further the same coating materials as used in Example 1 were plasma-polymerized on a glass plate under the same conditions to form a film, about 11 $\mu$m in thickness. The film was tested by a pencil hardness tester according to JIS with the result listed in Table 2.

The carrier was also tested for moisture resistance and the change in the amount of charges on toner with lapse of time. Table 2 shows the results, which were evaluated according to the criteria of: Ex (excellent), Fa (fair) and Po (poor). Also listed in Table 2 is the electric resistance of the carrier as measured under a given load.

COMPARATIVE EXAMPLE 1

Ferrite carrier particles were coated with styrene-acrylic resin and vinylidene fluoride by the spray-drying process to obtain a coated carrier, which will be referred to as "carrier G." The carrier was tested for characteristics in the same manner as in Example 1. Table 2 shows the results.

EXAMPLES 2–6, COMPARATIVE EXAMPLES 2–6

Carriers B to F and H to L were prepared in the same manner as in Example 1 and were similarly tested. The same ferrite carrier as in Example 1 was coated under the conditions listed in Table 1. The power supply frequency was 13.56 MHz, and the substrate temperature was 70° C. at the start of the coating operation. The test results are given in Table 2.

COMPARATIVE EXAMPLE 7

The uncoated carrier was tested for characteristics in the same manner as in Example 1. The carrier will be referred to as "carrier M." Table 2 shows the results.

TABLE 1

| Carrier | Material and Flow Rate C | F | Si | Metal | Deposition time (min) | Power (W) | Total gas pressure (torr) |
|---|---|---|---|---|---|---|---|
| A | Butadiene 25 sccm | $F_8C_5MA$ 110 sccm | — | — | 65 | 90 | 1.4 |
| B | SAR* 70 sccm | $CF_4$ gas 90 sccm | — | $SnCl_4$* 8 sccm | 90 | 85 | 1.9 |
| C | Styrene* 10 sccm | — | Vinylsilane 60 sccm | TMA* 60 sccm | 100 | 75 | 1.0 |
| D | Isoprene* 30 sccm | $CF_4$ gas 83 sccm | $SiH_4$ gas 40 sccm | $TiCl_4$* 21 sccm | 98 | 85 | 1.8 |
| E | SAR* 50 sccm | Vinylidene fluoride 50 sccm | — | $In(C_2H_5)_3$* 40 sccm | 100 | 90 | 1.4 |
| F | Butadiene 20 sccm | — | Vinysilane 90 sccm | — | 105 | 80 | 1.5 |
| G | SAR* — | Vinylidene fluoride — | — | — | — | — | — |
| H | — | $F_8C_5MA$* 60 sccm + $CF_4$ gas 20 sccm | Vinylsilane 50 sccm + $Si_2H_6$gas 30 sccm | — | 100 | 75 | 2.1 |
| I | SAR* 40 sccm | Vinyl fluoride 45 sccm | — | — | 90 | 75 | 1.3 |

TABLE 1-continued

| Carrier | Material and Flow Rate C | F | Si | Metal | Deposition time (min) | Power (W) | Total gas pressure (torr) |
|---|---|---|---|---|---|---|---|
| J | Isoprene* 50 sccm | — | Vinylsilane 41 sccm | — | 85 | 69 | 1.3 |
| K | SAR* 60 sccm | $CF_4$ gas 19 sccm | — | — | 95 | 85 | 1.2 |
| L | Styrene* 10 sccm | — | Vinylsilane 48 sccm | TMA* 79 sccm | 115 | 90 | 1.8 |

*Liquid material used as vaporized.
SAR = styrene-acrylic resin
TMA = tetramethylaluminum

TABLE 2

| Carrier | Content (wt. %) F | Si | Metal | Film thickness (μm) | Pencil hardness (H) | Amount of charges (μc/g) 1 min. later | 10 min. later | Abrasion resistance | Change with time | Moisture resistance | Electric resistance(Ω · cm) |
|---|---|---|---|---|---|---|---|---|---|---|---|
| A | 32 | — | — | 0.28 | 8 | 15 | 14 | Go | Ex | Ex | $2.1 \times 10^{13}$ |
| B | 8.1 | — | 0.2 | 0.3 | 7–8 | 10 | 15 | No | Ex | Ex | $9.8 \times 10^{11}$ |
| C | — | 15.2 | 8.6 | 0.32 | 7 | 9.3 | 13.9 | Go | Ex | Ex | $1.2 \times 10^{11}$ |
| D | 7.1 | 5.2 | 1.9 | 0.3 | 8–9 | 10.1 | 13.8 | Go | Ex | Ex | $1.1 \times 10^{11}$ |
| E | 19.7 | — | 3.5 | 0.29 | 7–8 | 9.0 | 12.5 | Go | Ex | Ex | $0.9 \times 10^{11}$ |
| F | — | 23 | — | 0.3 | 8–9 | 7.8 | 10.8 | Go | Ex | Ex | $3.7 \times 10^{10}$ |
| G | — | — | — | 0.4 | (up to 2) | 3.0 | 20.1 | Po | No | No | $1.1 \times 10^{12}$ |
| H | 31 | 29.8 | — | 0.3 | 7 | 13.5 | 17.5 | Go | Po | Po | $2.4 \times 10^{12}$ |
| I | 4.8 | — | — | 0.33 | 7–8 | 5.0 | 8.5 | Po | Po | Ex | $2.5 \times 10^{10}$ |
| J | — | 4.6 | — | 0.35 | 8 | 2.3 | 5.1 | Po | No | No | $7.8 \times 10^{9}$ |
| K | 0.9 | — | — | 0.3 | 7 | 0.5 | 4.1 | Po | Po | Ex | $0.9 \times 10^{9}$ |
| L | — | 10.1 | 9.2 | 0.3 | 8 | 2.2 | 1.1 | Go | Po | Po | $1.5 \times 10^{8}$ |
| M | — | — | — | — | — | 2.5 | 2.3 | — | No | Po | up to $7 \times 10^{8}$ |

The carriers of the present invention were 2 to 3 orders of magnitude higher than the noncoated carrier M of Comparative Example 7 in electric resistance. This overcomes the problem of carrier development due to the bias charge injection from the sleeve during development.

The carriers of the invention were higher in hardness than carrier G of Comparative Example 1. The film was smooth and free from pinholes and exhibited good adhesion to the core. They were insoluble in solvents and had elevated Tg and Tm values.

The toner admixed with carrier G of Comparative Example 1 was slow in the rise of charges and exhibited a reduced amount of charges when used for making 30,000 copies, whereas the present invention assured an excellent rise in the amount of charges and a satisfactorily maintained charge amount even after 60,000 copies were made.

Further the metal incorporated in the plasma-polymerized film according to the invention greatly diminished variations in the amount of charges on the toner and afforded a stabilized amount of charges during a long-term operation as in the case of carriers B to E shown in FIG. 16.

Although still remaining to be fully clarified, the reason will presumably be that the presence of metal prevents excessive charging of the carrier itself. More specifically stated, the plasma-polymerized film, even if thin, gives a high resistance to the carrier, consequently permitting the carrier to repeat in a short period triboelectric charging and discharging to the developing sleeve or the like due to overcharging and thereby varying the amount of charges on the toner. Accordingly, the incorporation of a suitable amount of metal prevents overcharging of the carrier itself to result in a stabilized amount of toner charges.

The present invention is not limited to the foregoing embodiments. When a ferrite carrier was merely subjected to plasma treatment using $CF_4$ or the like (flow rate: 100 sccm, frequency: 100 KHz, Power: 100 W), the result achieved was comparable to that attained in Example 1.

The plasma-polymerized film can be discrete insofar as the carrier particles are uniformly coated regularly.

Briefly, the plasma-polymerized film coating the carrier improves the carrier in its own chargeability, abrasion resistance and water repellency, further making it possible to control the electrification rank of the carrier itself.

Further according to the invention, the materials to be used for coating can be uniformly blended in vapor phase with ease to form a film of uniform quality. This also assures facilitated design of materials.

Further the present carrier is uniformly coated with a plasma-polymerized film having a small thickness of about several tens of angstroms to about 10,000 angstroms, so that the developer incorporating the carrier has improved flowability without impairment in its magnetic adhesion to the sleeve and is controllable in chargeability and charge rise time. The present carrier to which the toner will not adhere is repeated usable with excellent characteristics.

On the other hand, the carrier of the present invention is produced by the low-temperature dry process of plasma polymerization and is therefore free of the likelihood that heat or solvent would degrade the carrier material during coating.

What is claimed is:

1. A developer for use in developing an electrostatic latent image which comprises a carrier and a toner, wherein said carrier comprises a core and a coating layer of a hydrocarbon film prepared by plasma polymerization, and said film contains fluorine in an amount of 5 to 60% by weight and metal atoms in an amount of 0.1 to 9% by weight, and has a thickness of 80 to 15000 Å.

2. A developer for use in developing an electrostatic latent image as claimed in claim 1, wherein the core comprises a magnetic material.

3. A developer for use in developing an electrostatic latent image which comprises a carrier and a toner, wherein said carrier comprises a core and a coating layer of a hydrocarbon film prepared by plasma polymerization, and said film contains silicon in an amount of 5 to 60% by weight and metal atoms in an amount of 0.1 to 9% by weight, and has a thickness of 80 to 15000 Å.

4. A developer for use in developing an electrostatic latent image as claimed in claim 3, wherein the core comprises a magnetic material.

5. A developer for use in developing an electrostatic latent image which comprises a carrier and a toner, wherein said carrier comprises a core and a coating layer of a hydrocarbon film prepared by plasma polymerization, and said film contains both fluorine and silicon in an amount of 5 to 60% by weight and metal atoms in an amount of 0.1 to 9% by weight, and has a thickness of 80 to 15000 Å.

6. A developer for use in developing an electrostatic latent image as claimed in claim 5, wherein the core comprises a magnetic material.

* * * * *